US012733758B2

(12) United States Patent
Castle

(10) Patent No.: US 12,733,758 B2
(45) **Date of Patent: *Sep. 15, 2026**

(54) INFLATABLE PILLOW WITH WARMING/COOLING PAD POCKETS

(71) Applicant: Castle Fit Corporation, Atlanta, GA (US)

(72) Inventor: Daniel Castle, Atlanta, GA (US)

(73) Assignee: Castle Fit Corporation, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/172,488

(22) Filed: Apr. 7, 2025

(65) Prior Publication Data

US 2025/0235019 A1 Jul. 24, 2025

Related U.S. Application Data

(63) Continuation of application No. 17/960,012, filed on Oct. 4, 2022, now Pat. No. 12,349,828.

(51) Int. Cl.
*A47G 9/10* (2006.01)

(52) U.S. Cl.
CPC ..... *A47G 9/1027* (2013.01); *A47G 9/1036* (2013.01)

(58) Field of Classification Search
CPC ..... A47G 9/1027; A47G 9/1036; A61F 2007/002; A47C 7/383
See application file for complete search history.

(56) References Cited

U.S. PATENT DOCUMENTS

| | | | | |
|---|---|---|---|---|
| 1,580,210 | A * | 4/1926 | Mcculloch | A47G 9/10 5/636 |
| 3,968,529 | A | 7/1976 | Levin et al. | |
| 4,932,089 | A | 6/1990 | Laviero | |
| 5,168,590 | A | 12/1992 | O'sullivan | |
| 5,297,304 | A | 3/1994 | O'sullivan | |
| 5,367,731 | A | 11/1994 | O'sullivan | |
| 5,771,514 | A | 6/1998 | Wilhoit | |
| 5,916,088 | A | 6/1999 | Gueli | |
| 5,948,013 | A | 9/1999 | Swezey et al. | |
| 6,524,331 | B1 | 2/2003 | Kohout et al. | |
| 7,578,015 | B1 | 8/2009 | Wilson et al. | |

(Continued)

FOREIGN PATENT DOCUMENTS

| | | | |
|---|---|---|---|
| CN | 106333573 | A | 1/2017 |
| CN | 113545637 | A | 10/2021 |
| CN | 116671765 | A | 9/2023 |

*Primary Examiner* — Eric J Kurilla
(74) *Attorney, Agent, or Firm* — Lynch LLP; Sean Lynch

(57) ABSTRACT

The inventive subject matter is directed to inflatable pillows that are useful in the context of non-pharmaceutical therapies. Pillows of the inventive subject matter comprise a hexagonal top surface, a hexagonal bottom surface, and one or more pockets that allow users to place warming/cooling pads beneath the top surface of the pillow. In some embodiments, up to three pockets can be included, where each pocket is accessible along an edge of the top surface. When divided into third, each pocket can be accessible along an edge of the hexagonal outer edge of the top surface such that a user's neck can rest along that edge to improve contact with a warming/cooling pad. Embodiments include an air hub to facilitate inflation and deflation, and a stiff pillow base can be included as well.

14 Claims, 6 Drawing Sheets

(56) References Cited

U.S. PATENT DOCUMENTS

| | | | | |
|---|---|---|---|---|
| 9,173,501 | B1 * | 11/2015 | Garner | A47C 16/00 |
| 9,247,836 | B2 | 2/2016 | Dupré | |
| 10,973,345 | B1 | 4/2021 | Kirk | |
| 11,751,704 | B2 | 9/2023 | Kirk | |
| 12,349,828 | B2 * | 7/2025 | Castle | A47G 9/1081 |
| 2002/0078506 | A1 | 6/2002 | Sloot | |
| 2003/0028971 | A1 | 2/2003 | Chaffee | |
| 2005/0223493 | A1 | 10/2005 | Setokawa et al. | |
| 2007/0067915 | A1 | 3/2007 | Pryor | |
| 2011/0275966 | A1 | 11/2011 | Alkhattaf | |
| 2012/0227185 | A1 | 9/2012 | Batiste et al. | |
| 2013/0117939 | A1 * | 5/2013 | Moss | A47G 9/1027 5/636 |
| 2013/0276236 | A1 * | 10/2013 | Rasmussen | A47G 9/1027 5/636 |
| 2014/0008036 | A1 | 1/2014 | Segal | |
| 2015/0164251 | A1 | 6/2015 | Hsu | |
| 2019/0239668 | A1 | 8/2019 | Sabulao | |
| 2020/0054155 | A1 | 2/2020 | Komatick | |
| 2022/0000289 | A1 | 1/2022 | Ho | |
| 2022/0015941 | A1 | 1/2022 | Lamb | |
| 2022/0022669 | A1 | 1/2022 | Castaldo | |
| 2022/0338639 | A1 | 10/2022 | Smidel | |
| 2024/0081561 | A1 | 3/2024 | Arnett et al. | |

* cited by examiner

INFLATABLE PILLOW WITH WARMING/COOLING PAD POCKETS

FIELD OF THE INVENTION

The field of the invention is inflatable pillows for non-pharmaceutical treatments.

BACKGROUND

The background description includes information that may be useful in understanding the present invention. It is not an admission that any of the information provided in this application is prior art or relevant to the presently claimed invention, or that any publication specifically or implicitly referenced is prior art.

In the field of sports medicine, many therapies are non-pharmaceutical. Physical therapy is one discipline that implements such non-pharmaceutical techniques to encourage healing, address injury, and even prevent injury. For example, physical therapists offer massages, vibration therapy, targeted stretching, and so on. To help with these therapies, physical therapists have access to many different tools. For example, foam rollers, myofascial rollers, vibration guns, stretching cages, and the like can also be used.

As physical therapists gain access to new tools, demand from home consumers increases for the same or similar tools that can be used in the home. Tools like foam rollers and myofascial rollers can easily be bought for home use, and more recently vibration guns have reached consumer markets. Consumer markets for such products has continued to grow over time.

In addition to active tools (e.g., those that need some kind of active manipulation like a foam roller), passive tools make up a large portion of the consumer market. For example, warming and cooling pads can be used to promote healing in sore, strained, or injured muscles. Specially designed pillows can be used to promote healing in the neck and shoulders. Despite existing products, there still exists room for innovation especially related to specialty pillows, even more so when specially made pillows are combined with warming and cooling elements.

Thus, there is still a need in the art for therapeutic pillows that are lightweight, portable, inflatable, and can incorporate warming and cooling pads.

SUMMARY OF THE INVENTION

The present invention provides apparatuses, systems, and methods directed to inflatable pillows for non-pharmaceutical treatments. In one aspect of the inventive subject matter, an inflatable pillow comprises: a pillow body comprising a fabric; a bottom surface of the pillow body comprising a bottom hexagonal outer edge; a top surface of the pillow body comprising a top hexagonal outer edge, wherein the top surface is concave; the top surface comprising a pocket, where the pocket is accessible along a portion of the top hexagonal outer edge; and an air hub comprising a valve.

In some embodiments, the pocket is configured to accommodate a warming/cooling pad beneath at least a portion of the top surface. The air hub can include a second valve that is separated from the valve by a base plate, where both the valve and the second value are fixedly coupled with the base plate. The valve and the second valve can include a valve stem and a second valve stem, respectively, and the valve stem and the second valve stem can each have threading to which a threaded nut and a second threaded nut can tighten to create an airtight seal between the base plate and the pillow fabric.

In some embodiments, the pillow also includes a warming/cooling pad that is configured to fit within the pocket. The top surface can also have a second pocket and a third pocket, where each of the pocket, the second pocket, and the third pocket occupy equal portions of the top surface.

Some pillows can include a stiff pillow base, where the pillow base comprises at least one strap to store the pillow body upon deflation. The bottom surface of the pillow body can include a strap to store a pillow base while the pillow body is inflated.

In another aspect of the inventive subject matter, an inflatable pillow comprises: a pillow body comprising a fabric; a bottom surface of the pillow body comprising a bottom edge; a top surface of the pillow body comprising a top edge; the top surface comprising a pocket, where the pocket is accessible along a portion of the top edge; and an air hub comprising a valve.

In some embodiments, the pocket is configured to accommodate a warming/cooling pad beneath at least a portion of the top surface. The air hub can include a second valve that is separated from the valve by a base plate, where both the valve and the second value are fixedly coupled with the base plate.

The valve and the second valve can include a valve stem and a second valve stem, respectively, where the valve stem and the second valve stem each have threading to which a threaded nut and a second threaded nut can tighten to create an airtight seal between the base plate and the pillow fabric. The pillow can also include a warming/cooling pad that is configured to fit within the pocket. The top surface of the pillow can also include a second pocket and a third pocket, where each of the pocket, the second pocket, and the third pocket occupy equal portions of the top surface.

In some embodiments, the pillow also include a stiff pillow base, wherein the pillow base comprises at least one strap to store the pillow body upon deflation. The bottom surface of the pillow body can also include a strap to store a pillow base while the pillow body is inflated.

Various objects, features, aspects, and advantages of the inventive subject matter will become more apparent from the following detailed description of preferred embodiments, along with the accompanying drawing figures in which like numerals represent like components.

DETAILED DESCRIPTION

The following discussion provides example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As used in the description in this application and throughout the claims that follow, the meaning of "a," "an," and "the" includes plural reference unless the context clearly dictates otherwise. Also, as used in the description in this application, the meaning of "in" includes "in" and "on" unless the context clearly dictates otherwise.

Also, as used in this application, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth in this application should be interpreted as being inclusive of their endpoints and open-ended ranges should be interpreted to include only commercially practical values. Similarly, all lists of values should be considered as inclusive of intermediate values unless the context indicates the contrary.

Figure 1:
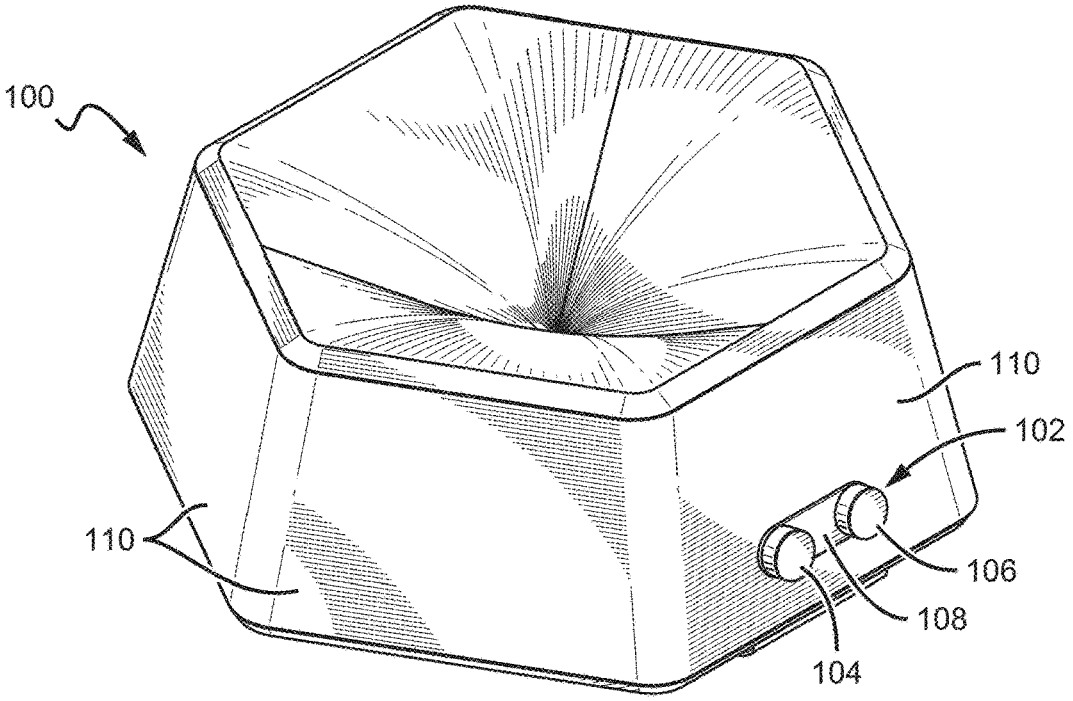
FIG. 1 is a perspective view of a pillow of the inventive subject matter.
Figure 2:
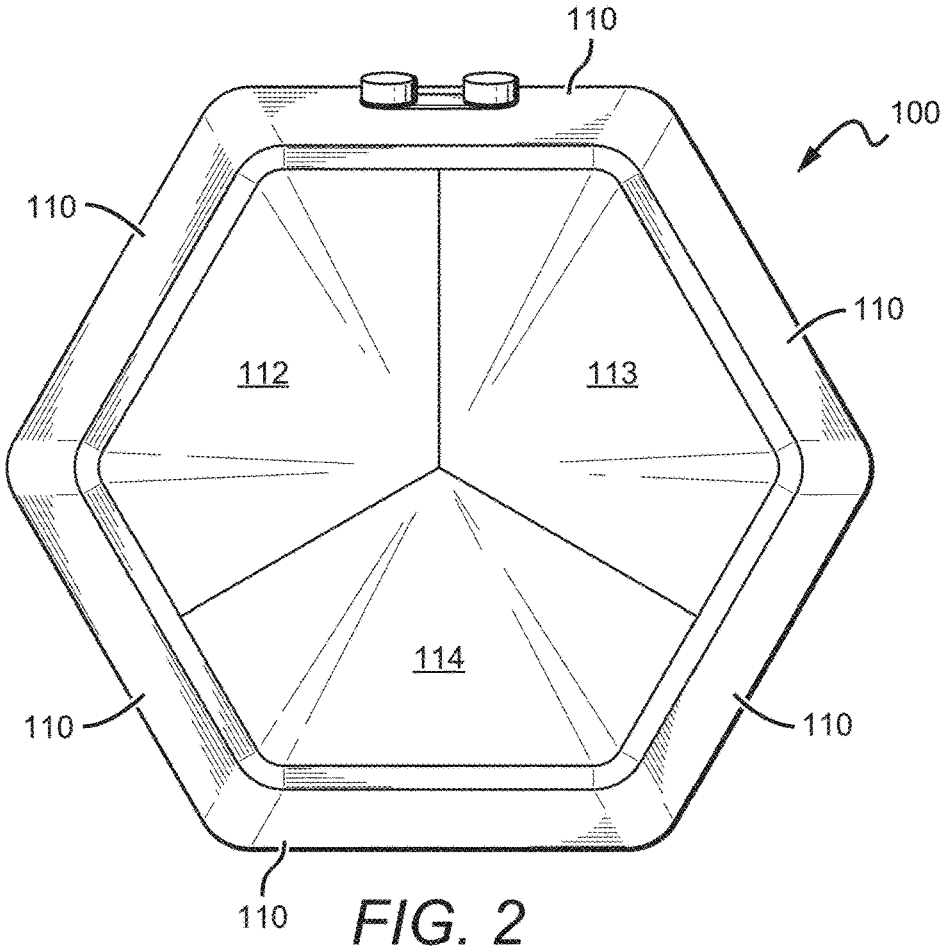
FIG. 2 is a top view thereof.

Pillows of the inventive subject matter are inflatable, shaped as hexagons, and features pockets that allow for the insertion of, e.g., warming or cooling pads. FIG. 1 shows pillow 100 in a perspective view. From this angle, an air hub 102 is visible on a side. Air hub 102 features two threaded caps 104 & 106 that screw onto valve stems that pass through base plate 108. Each side of pillow 100 can be largely flat. The top surface of pillow 100 is divided into thirds, where each third features a pocket for a warming or cooling pad. Like the bottom surface, top surface of pillow 100 is shaped as a hexagon, though it is smaller than the bottom surface, giving rise to angled sides 110. FIG. 2 is a top view of pillow 100 showing three different sections 112, 113, 114 of its top surface. These three sections 112, 113, 114 are angled to create a concave top surface where a user can rest their head comfortably. The three sections can be divided by lines extending from the center of the top surface of pillow 100 to the middle of thee of the hexagonal sides of the top surface of pillow 100, thus dividing the top surface into thirds to create three equally sized pockets. These dividing lines can be seen in, e.g., FIG. 2. By dividing the pillow in this manner, a user's neck can rest on a flat edge of the top surface, allowing a single warming/cooling pad to contact the user's neck in a largely symmetrical manner.

Figure 3:
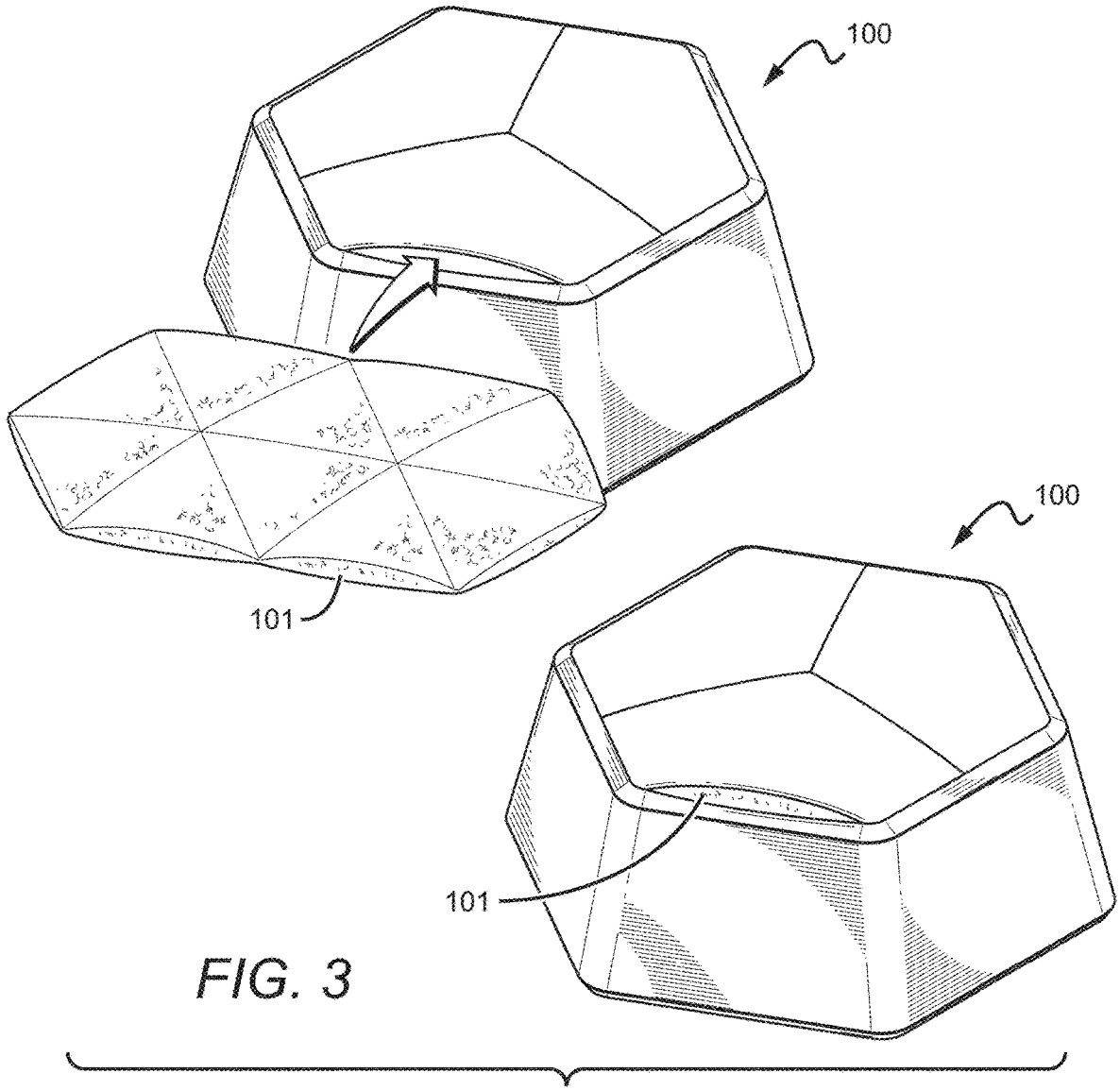
FIG. 3 shows a warming/cooling pad and how it can be inserted into a pocket on a top surface of the pillow.

FIG. 3 shows how a warming/cooling pad 101 can be inserted into pillow 100. Each of the three different sections on the top surface of pillow 100 can open along an edge so warming/cooling pad 101 can be inserted. Each of the three sections can accommodate a warming/cooling pad or, in some embodiments, other types of inserts like cushions and textured pads. Warming/cooling pad 101 is shaped as an elongated hexagon with sides angled to match the angular sides of the pillow's pockets, which helps to keep warming/cooling pad 101 in place while it is inserted into pillow 100. Warming/cooling pad 101 can also feature stitches in a pattern (e.g., X's) to prevent clumping or accumulating of its internal contents in any one portion of the warming/cooling pad.

Figure 4:
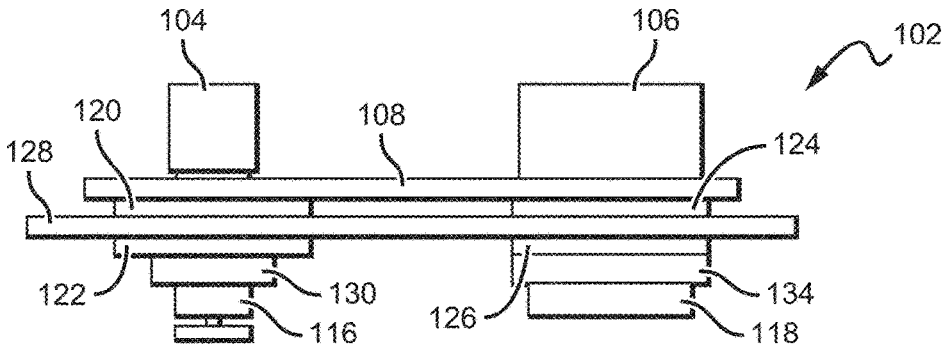
FIG. 4 shows an air hub of the inventive subject matter.

FIG. 4 shows air hub 102 from a side view. Threaded caps 104 & 106 are shown screwed down onto valve stems 116 & 118. Base plate 108 acts as a spacer for valve stems 116 & 118 and gives structural stability to air hub 102. Valve stems 116 & 118 are fixedly coupled with base plate 108. Because valve stems 116 & 118 must pass through a side of pillow 100 (e.g., they must pass through the fabric), gaskets 120, 122, 124, and 126 are implemented. Gaskets 120 and 122 fit around valve stem 116 and are placed on either side of pillow fabric 128. Pillow fabric can be elastic or inelastic. Fastener 130 (e.g., a nut) is screwed onto fastener threads 132 (shown in FIG. 5) and, in doing so, compresses gaskets 120 and 122 between fastener 130 and base plate 108, which creates an airtight seal around pillow fabric 128. Similarly, gaskets 124 and 126 fit around valve stem 118 and are placed on either side of pillow fabric 128. Fastener 134 (e.g., a nut) is screwed onto fastener threads 136 (shown in FIG. 5) and, in doing so, compresses gaskets 124 and 126 between fastener 134 and base plate 108, which also creates an airtight seal around pillow fabric 128. Pillows of the inventive subject matter can be inflated by pump or manually via a user's mouth.

Figure 5:
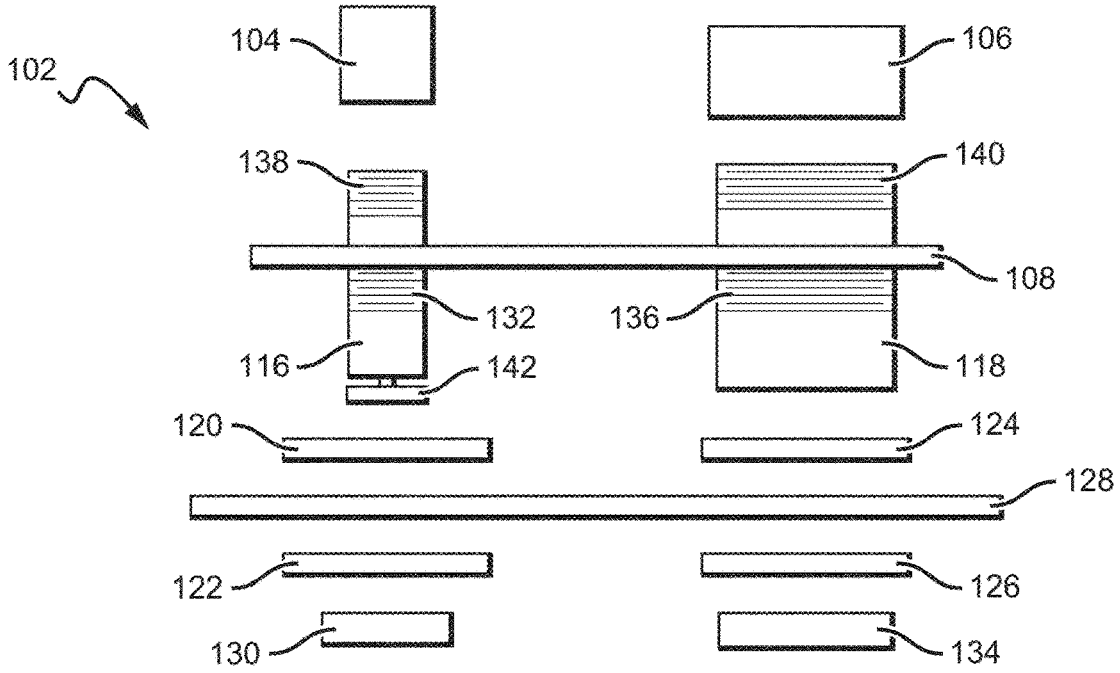
FIG. 5 shows an exploded view of the air hub.

FIG. 5 shows an exploded view of air hub 102. From this view, cap threads 138 & 140 are visible as threaded caps 104 and 106 are removed from valve stems 116 & 118. Valve stems 116 & 118 are shown passing through base plate 108. Valve stems 116 & 118 have threads on either side of base plate 108, with cap threads 138 & 140 being disposed on the tips of valve stems 116 & 118 and fastener threads 132 & 134 abutting the base plate 108.

In some embodiments, valve stem 116 can be compatible with different inflating devices than valve stem 118. For example, valve stem 116 can include a Schrader valve, a Presta valve, a Woods valve (e.g., types of valve compatible with bike pumps), and so on. Valve stem 118 can be used to inflate by mouth or deflate quickly. Other types of air valves can be implemented without deviating from the inventive subject matter. On the interior part (e.g., the part that is disposed in the interior of pillow 100) of valve stem 116, one-way air valve 142 can be included to minimize inadvertent deflation during the inflation process. One-way air valve 142 can be configured as, e.g., a reed valve. Thus, valves 116 & 118 extend through fabric of pillow 100 such that pillow 100 can be inflated (or, in some cases, deflated) via one or both of the valves.

Figure 6:
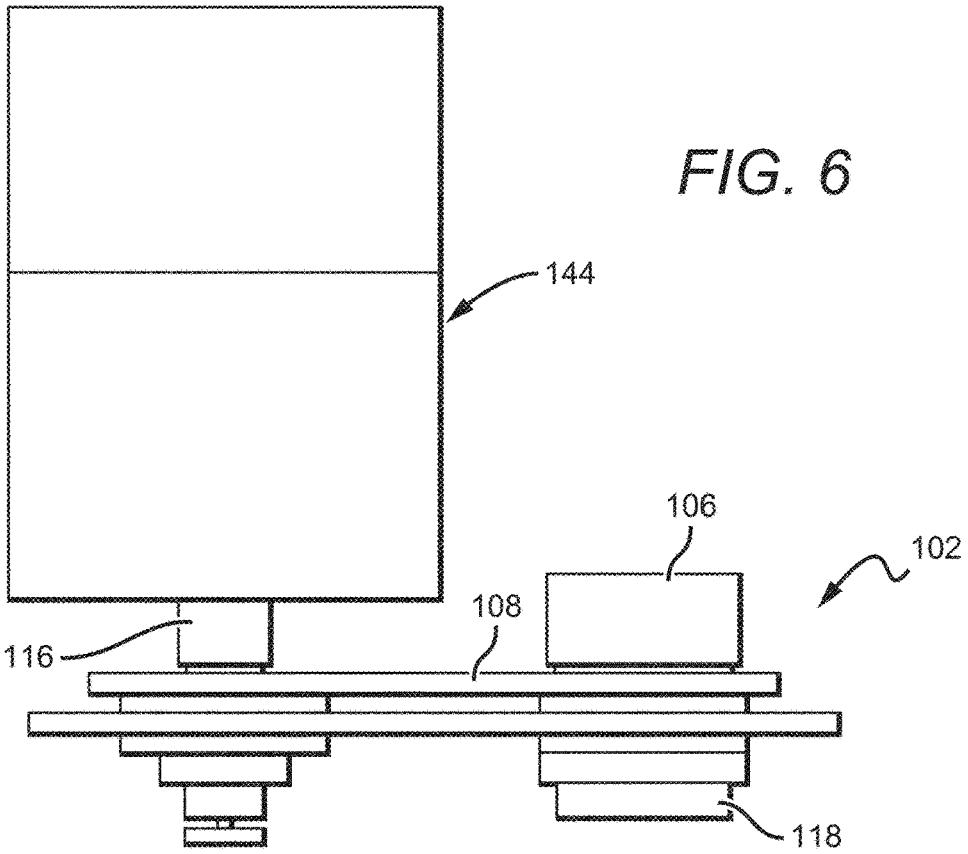
FIG. 6 shows the air hub with a pump connected to it.

FIG. 6 shows an air pump 144 coupled with valve stem 116. With threaded cap 104 removed, air pump 144 can couple with valve stem 116. Air pump 144 can then be used to add air to pillow 100 to inflate it. Valve stem 118, in some embodiments, can provide a larger diameter opening to the interior of pillow 100, which can be useful for, e.g., rapid deflation.

Figure 7:
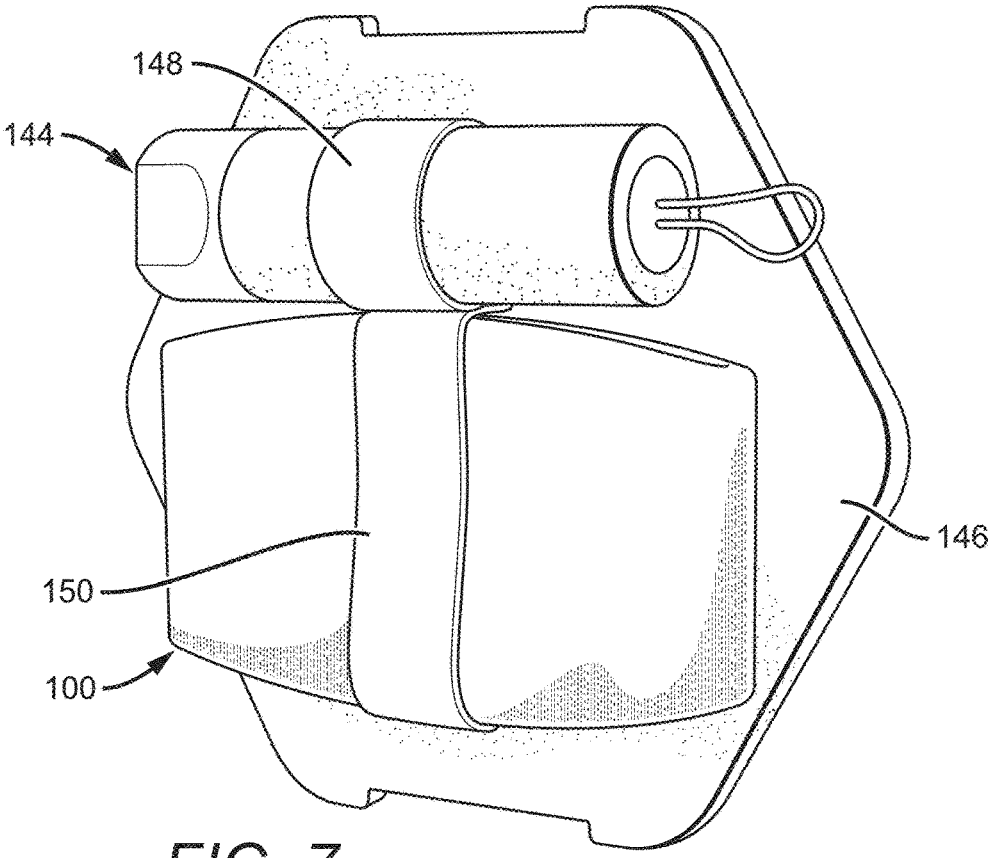
FIG. 7 shows the pillow and an air pump stored on a pillow base.

FIG. 7 shows pillow 100 in a disassembled configuration, with pillow 100 and air pump 144 stored on pillow base 146. Pillow base 146 can be made from a stiff material such as cork, wood, plastic, or the like, and it can include a pump strap 148 and a pillow strap 150 to store air pump 144 and pillow 100, respectively. A material like cork can be used to, e.g., increase friction between pillow base 146 and a surface that it rests on to minimize sliding movement of pillow 100 while in use. Pillow base 146 can feature notches at either end to make it easier to handle, pick up, move, to orient pillow base 146 relative to pillow 100 during use, and so on. Pillow base 146 can also be formed into a hexagon to match the overall shape of pillow 100. Pump strap 148 and pillow strap 150 can be made from a flexible and, in some embodiments, a stretchable material.

Figure 8A:
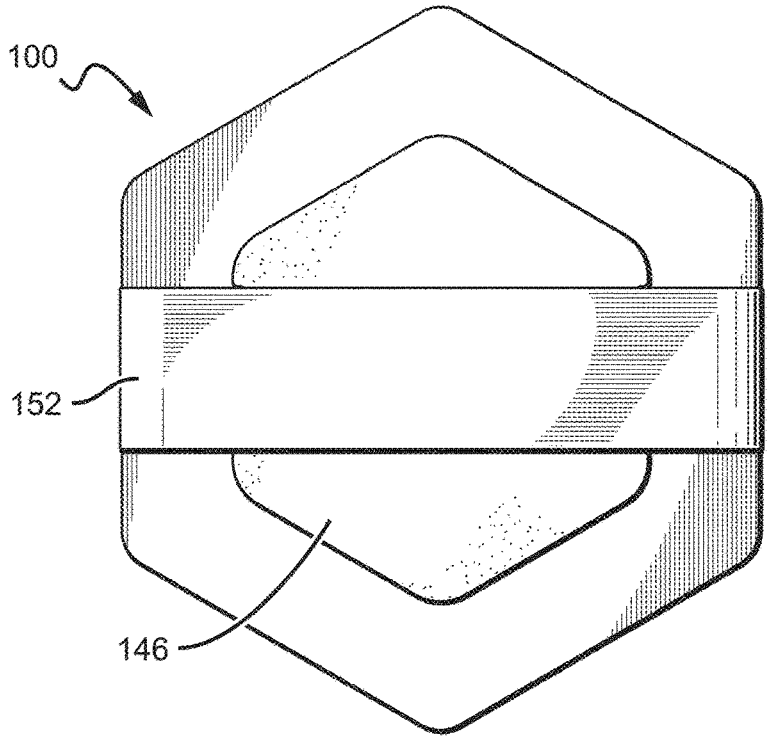
FIG. 8A shows pillow base coupled to pillow fabric from a bottom view.
Figure 8B:
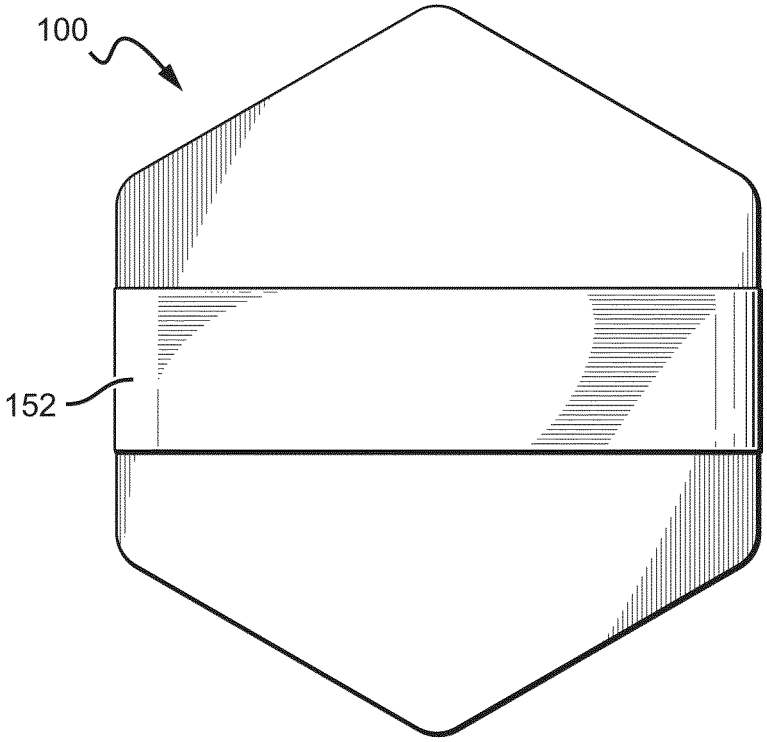
FIG. 8B shows pillow fabric from a bottom view.
Figure 8C:
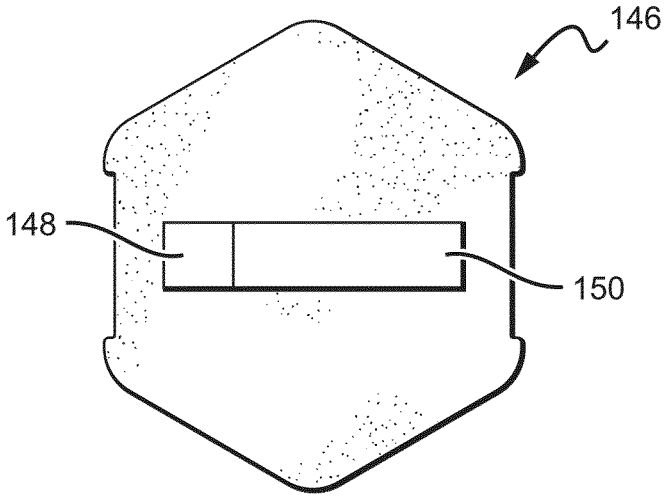
FIG. 8C shows pillow base from a bottom view.

FIGS. 8A shows the bottom of pillow 100 when it is inflated. From this view, pillow base 146 is shown between bottom strap 152 and the bottom of pillow 100. Bottom strap 152 couples with pillow 100 to create a space for pillow base 146, thus allowing for easy storage during use. FIG. 8B shows pillow 100 from the bottom without pillow base 146 held by bottom strap 152. FIG. 8C shows pillow base 146 without pillow 100.

Figure 9:
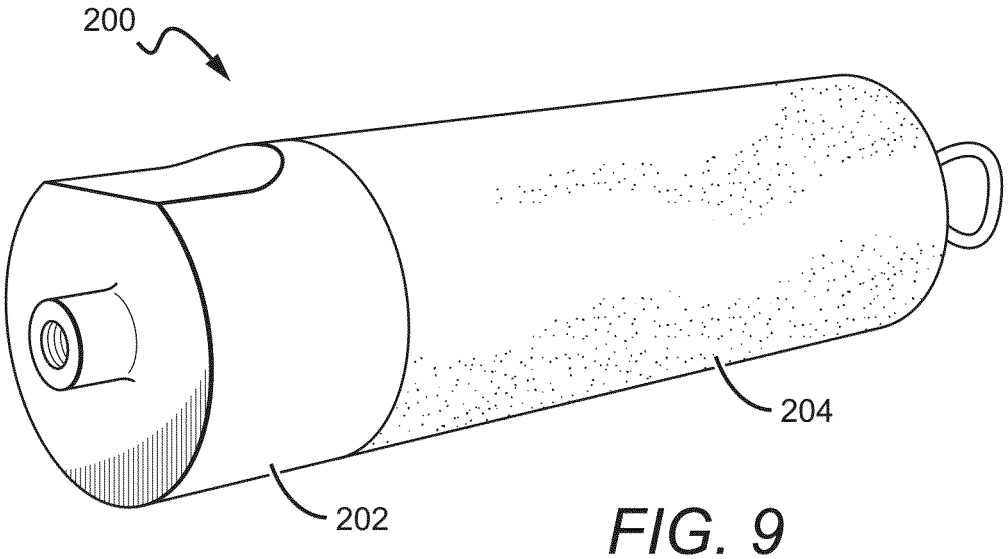
FIG. 9 is a front angled view of an air pump of the inventive subject matter.
Figure 10:
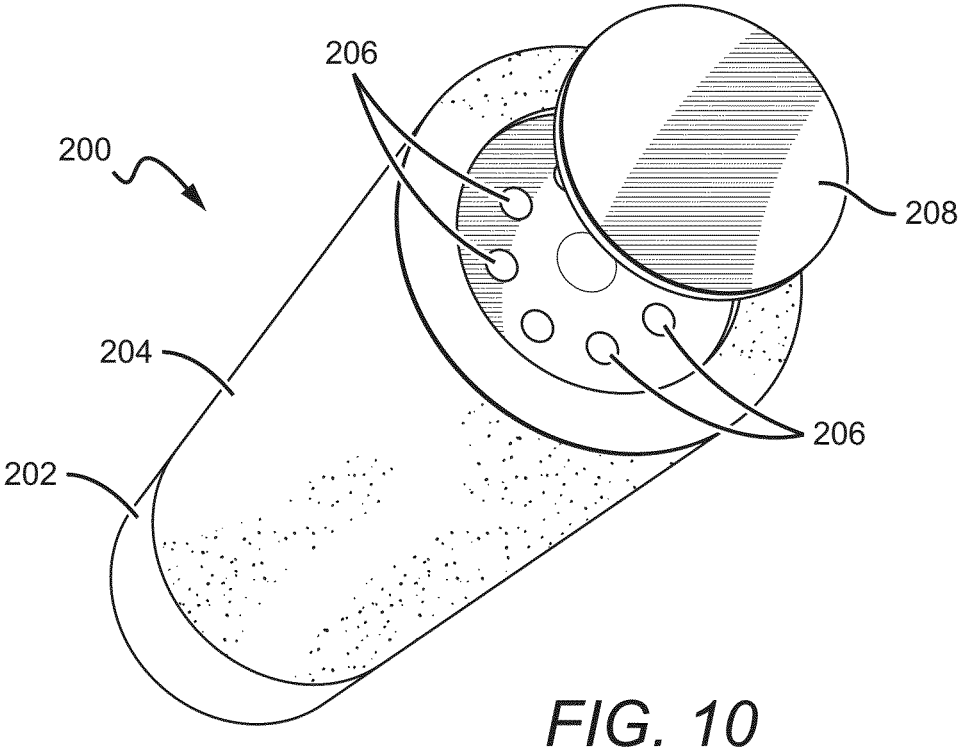
FIG. 10 is a rear angled view of an air pump of the inventive subject matter.

Pillows of the inventive subject matter can additionally include accompanying air pumps. Air pumps can be manually operated and can be used to inflate pillow 100. FIGS. 9 and 10 show air pump 200. Air pump 200 features a nozzle end 202 with a handle 204 on an opposite end. Handle 204 is pumped relative to nozzle end 202. During use, air is pulled into pump 200 via intake holes 206, which can be protected from pulling in detritus by cover 208.

Thus, specific systems and methods directed to inflatable pillows are disclosed. It should be apparent, however, to those skilled in the art that many more modifications besides those already described are possible without departing from the inventive concepts in this application. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. An inflatable pillow comprising:

a pillow body;

a bottom surface of the pillow body comprising a bottom hexagonal outer edge, wherein the bottom surface of the pillow body comprises a strap to store a pillow base while the pillow body is inflated;

a top surface of the pillow body comprising a top hexagonal outer edge, wherein the top surface comprises a concave portion; and a stiff pillow base, wherein the pillow base comprises a second strap to store the pillow body upon deflation.

2. The inflatable pillow of claim 1, further comprising a pocket that is configured to accommodate a warming/cooling pad beneath at least a portion of the top surface.

3. The inflatable pillow of claim 2, further comprising a warming/cooling pad that is configured to fit within the pocket.

4. The inflatable pillow of claim 2, wherein the top surface further comprises a second pocket and a third pocket, where each of the pocket, the second pocket, and the third pocket occupy equal portions of the top surface.

5. The inflatable pillow of claim 1, further comprising an air hub having a first valve and a second valve.

6. The inflatable pillow of claim 5, wherein the air hub comprises a second valve that is separated from the first valve by a base plate, where both the first valve and the second valve are fixedly coupled with the base plate.

7. The inflatable pillow of claim 6, wherein the first valve and the second valve comprise a valve stem and a second valve stem, respectively, and wherein the valve stem and the second valve stem each comprise threading to which a threaded nut and a second threaded nut can tighten to create an airtight seal between the base plate and the pillow body.

8. An inflatable pillow comprising:

a pillow body;

a bottom surface of the pillow body comprising a bottom hexagonal outer edge. wherein the bottom surface of the pillow body comprises a second strap to store a pillow base while the pillow body is inflated;

a top surface of the pillow body comprising a top hexagonal outer edge, wherein the top surface comprises a concave portion;

further comprising a stiff pillow base, wherein the pillow base comprises at least one strap to store the pillow body upon deflation.

9. The inflatable pillow of claim 8, wherein the top surface further comprises a pocket, wherein the pocket is accessible along a portion of the top hexagonal outer edge.

10. The inflatable pillow of claim 9, further comprising a warming/cooling pad that is configured to fit within the pocket.

11. The inflatable pillow of claim 9, wherein the top surface further comprises a second pocket and a third pocket, where each of the pocket, the second pocket, and the third pocket occupy equal portions of the top surface.

12. The inflatable pillow of claim 8, further comprising an air hub comprising a valve.

13. The inflatable pillow of claim 12, wherein the air hub comprises a second valve that is separated from the valve by a base plate, where both the valve and the second valve are fixedly coupled with the base plate.

14. The inflatable pillow of claim 13, wherein the valve and the second valve comprise a valve stem and a second valve stem, respectively, and wherein the valve stem and the second valve stem each comprise threading to which a threaded nut and a second threaded nut can tighten to create an airtight seal between the base plate and the pillow body.

* * * * *